US005722205A

United States Patent [19]

Gannaway

[11] Patent Number: 5,722,205

[45] Date of Patent: Mar. 3, 1998

[54] SELF-INSTALLING POST

[76] Inventor: Richard M. Gannaway, 819 Greenfield Dr., Palm Harbor, Fla. 34684

[21] Appl. No.: 780,679

[22] Filed: Jan. 8, 1997

Related U.S. Application Data

[63] Continuation of Ser. No. 593,907, Jan. 30, 1996, abandoned.

[51] Int. Cl.[6] ..... E02D 5/74

[52] U.S. Cl. ..... 52/155; 52/165; 52/153

[58] Field of Search ..... 52/155, 165, 153

[56] References Cited

U.S. PATENT DOCUMENTS

| | | | |
|---|---|---|---|
| 142,687 | 9/1873 | Durant | 52/165 |
| 4,156,332 | 5/1979 | Thompson | 52/165 |
| 4,279,104 | 7/1981 | Classen | 52/165 X |
| 4,679,369 | 7/1987 | Kinsley et al. | 52/155 |
| 4,921,200 | 5/1990 | Moraley | 52/155 X |
| 4,939,877 | 7/1990 | Claffey | 52/155 |
| 4,951,904 | 8/1990 | Obenshain | 52/165 X |
| 5,076,032 | 12/1991 | Lehman | 52/165 X |
| 5,090,165 | 2/1992 | Kenny | 52/165 |
| 5,404,682 | 4/1995 | West | 52/155 X |

*Primary Examiner*—Carl D. Friedman
*Assistant Examiner*—W. Glenn Edwards
*Attorney, Agent, or Firm*—Terrance L. Siemens

[57] ABSTRACT

A post assembly for supporting a fence, a sign or receptacle such as a mailbox. The post assembly comprises a ground penetrating rod having an enlarged head, a square, hollow, decorative body placed over the rod after the rod is forced into the ground, and a footplate. The enlarged head of the rod cooperates in close fit within the hollow body. A pin frictionally fits into openings formed in the body, interfering with the rod as the body is lowered over the rod. The body is then employed as a driver to force the rod into the ground. When the rod is driven down to the point that the body contacts the footplate, the pin is removed from the body. The body then is lowered into abutment with the footplate. The openings of the body which receive the pin then align with a passage formed in the enlarged head of the rod. The pin is reinserted into the body, this time passing through the passage of the enlarged head of the rod. The rod and body are thus interlocked. The footplate has prongs for engaging the ground, and a hole through which the rod passes and in which the rod is maintained upright. The rod and the prongs of the footplate combine to secure the assembled post within the ground.

11 Claims, 6 Drawing Sheets

20
20
18
14
48
12
38
16

SELF-INSTALLING POST

This application is a continuation of application Ser. No. 08/593,907, filed Jan. 30, 1996 abandoned.

BACKGROUND OF THE INVENTION

1. Field of the Invention

The present invention relates to a post which employs its own components in erecting the post. These components include a ground penetrating rod, a hollow, square body, and a pronged footplate. The rod is inserted into a hole formed in the foot plate, which foot plate is then driven into the ground, engaging the ground by prongs. The footplate maintains the rod perpendicular to the ground. Next, the rod is driven into the ground, employing the body as a driver. The body is then placed in a final position over the rod, engaging the footplate, which maintains the body in a constant orientation.

The footplate plays a further role in determining how far to force the rod into the ground. When the body attains a predetermined distance proximate the footplate while serving as a driver, the rod is vertically aligned with the body so as to accept a pin locking the two together. The body is maintained erect by the rod, and prevented from contacting the ground by the footplate.

The finished post can be employed as a component of a fence, to support a mailbox or the like, and accepts a laterally projecting arm for supporting a pendant sign.

2. Description of the Prior Art

Setting a post for a fence, or for supporting a mailbox or sign is a seemingly easy task, but one which must be competently performed in order to enjoy satisfactory results. The post will possibly be subjected to a variety of influences tending to upset the post. At the least, wind and wind driven precipitation will likely act on the post. The post may be subjected to more extreme loads, such as bearing persons climbing on the fence or leaning against the post, being pulled during children's play, and so forth.

In addition to remaining structurally stable, it is desirable that the post retain certain aesthetic characteristics. For example, the post is preferably a square cut member, and should remain in a vertical, upright orientation. Also, the post should not penetrate the ground. It would be further desirable from an aesthetic standpoint that the post have a base giving the appearance of solid anchoring at the ground.

A sign post which is driven into the ground by impacts generated by a portion of the sign post is shown in U.S. Pat. No. 4,910,901, issued to Florene E. Boyar on Mar. 27, 1990. There are two principal components of this sign post, namely, a ground penetrating rod having an enlarged head, and a hollow post which slides coaxially over the rod. The post is rammed downwardly along the rod, interfering with the enlarged head. At this point, force is transmitted to the rod. The post will subsequently be positioned as desired on the rod, and maintained in the desired position by a setscrew. By contrast, the present invention has a pin which passes through the hollow member at selected points, so that contact with the rod occurs against the top of the ground rod. Position of this pin is adjusted as the ground penetrating rod progressively sinks into the ground. This feature is absent in the device of Boyar. Also, the present invention has a pronged base which guides the rod, maintaining the rod vertical, and which assists in determining how far into the ground to force the rod. The base will subsequently stabilize the assembled post, and will provide aesthetic appeal. This component is also absent in the device of Boyar.

U.S. Pat. No. 4,928,446, issued to Walter A. Alexander, Sr., on May 29, 1990, describes a break-away post. The post is driven into the ground by rotation. By contrast, the present invention employs the external body of the post to impart force by impact upon a rod. This rod moves linearly into the ground, and does not rotate. The device of Alexander, Sr. further lacks the adjustably positioned pin and pronged base of the instant invention.

A self-anchoring post is shown in U.S. Pat. No. 4,530,190, issued to Jack P. Goodman on Jul. 23, 1985. Goodman's post requires a tool for generating an impact propelling the post into the ground. No separate part of the final installed post is shown for both driving the post into the ground, and for providing a decorative, covering body. No part assists in determining how far into the ground to drive the post. By contrast, the present invention includes a square cut, hollow body which is placed over the ground penetrating rod and employed to drive the rod into the ground by pile driver action. This hollow body subsequently forms part of the final, completed post. Goodman lacks a plate which orients the rod vertically, assists in positioning the ground rod within the ground, and which remains at ground level.

U.S. Pat. No. 5,307,598, issued to Ronald R. West on May 3, 1994, describes a post system wherein a hollow body is anchored to a member which penetrates the ground. However, unlike the present invention, there is no provision for the hollow body to be employed in driving the rod. In another departure from the present invention, there is no ground mounted plate for driving the rod vertically into the ground. This function is superseded in West's system by an adjustment made after the ground penetrating member is driven into the ground.

None of the above inventions and patents, taken either singly or in combination, is seen to describe the instant invention as claimed.

SUMMARY OF THE INVENTION

The present invention provides an uncomplicated modular, interlocking post assembly which employs its own component parts during erection. The principal parts of the post include a rod for penetrating the ground and a decorative, hollow, square body. The rod is driven into the ground by the body, which will subsequently be placed over and supported by the rod. The body forms the visible portion of the post assembly after assembly. The body is preferably configured to simulate square cut lumber, so that the post assembly will be visually compatible with traditional carpentry construction.

The body has an internal cavity which cooperates with the rod. The rod has an enlarged head which both cooperates with the configuration of the internal cavity of the body, and which has a transverse passage formed therein. The body has opposed openings formed in its lateral wall. A pin is removably insertable into the opposed openings, and also penetrates the passage of the enlarged head of the rod.

Another component of the post assembly is a footplate. The footplate has an upper step which fits into the cavity of the body, and a lower step. When the body is lowered onto the footplate, it surrounds the upper step and is stopped by interference with the lower step. The footplate both provides a base for the body, and assists in determining when the passage of the head of the rod is aligned with the openings in the body, so that the pin can be inserted for final assembly.

The footplate also has a vertical bore allowing passage therethrough of the rod, and ground engaging prongs. The footplate is placed on the ground in a preferred location, and the pointed end of the rod is placed in the vertical bore. With the pin installed in the body by engaging the two opposed openings, the body is lowered over the rod and employed as a driver. The pin delivers repeated impacts to the enlarged head of the rod.

When the lowermost surface of the body contacts or reaches the upper step of the footplate, the pin is removed from the body. The openings in the body and the passage of the head of the rod are now aligned, so that the pin can be reinserted into the body. The pin passes through the passage of the head of the rod, so that the rod is interlocked with the body. The body rests on the footplate, thereby resisting further downward penetration into the ground. The footplate is stabilized by both engagement with the body and by engagement of the ground by its prongs.

Preferably, the openings formed in the body are located at a predetermined distance from the bottom edge of the body, such that alignment of the openings with the passage formed in the enlarged head of the rod is indicated. When the body contacts the upper step of the footplate, the pin is removed, the body lowers into contact with the lower step of the footplate, and alignment of the openings with the passage ensues.

If desired, decorative and protective caps may be installed on the ends of the pin. This practice serves to protect the interior of the body from contamination with dirt, ice, and like contaminants, and also improves the appearance of the pin.

Optionally, a lateral arm may be attached to and supported by the body. A sign can be suspended from the arm, while providing visually pleasing, traditional construction.

Other uses of the novel post assembly include supporting a fence, and supporting a mailbox or other receptacle for receiving and storing articles. The post assembly optionally includes structure for mounting a receptacle thereto. The receptacle may be an otherwise conventional mailbox, an open receptacle for receiving newspapers and like materials, or any other partially or fully enclosed receptacle intended for reception and temporary storage of various articles.

Thus, it will be seen that a sturdy and attractive post is provided, which requires no tools for assembly.

Accordingly, it is a principal object of the invention to provide a sturdy and attractive post assembly.

It is another object of the invention to eliminate requirement of tools when erecting the post assembly.

It is a further object of the invention to provide a modular post assembly.

Still another object of the invention is to provide a post which does not require digging of a hole for its erection.

An additional object of the invention is to enable attachment of a sign or mailbox or like receptacle to the post, or to support a fence.

It is again an object of the invention to indicate alignment of openings formed in the body with a passage formed in the rod, to assist in interlocking body and rod.

Still another object of the invention is to seal the ends of the pin, thereby protecting the interior of the body from contaminants.

Yet another object of the invention is to provide a base for assisting in erection of the post and for assisting in maintaining the post assembly stable after erection.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
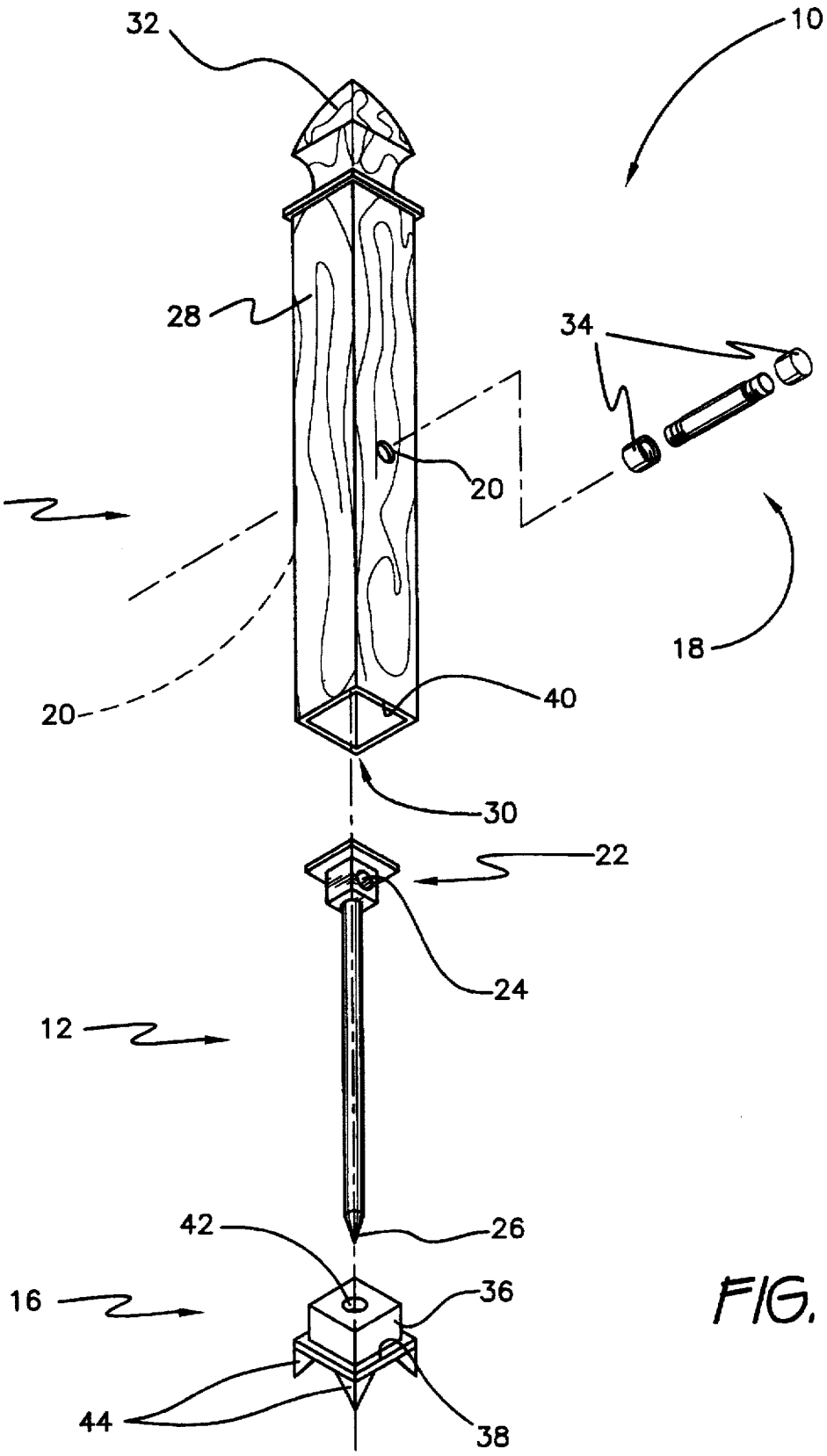
FIG. 1 is an exploded, isometric view of the invention.

Turning now to FIG. 1 of the drawings, the novel post assembly 10 is seen to comprise a rod 12 for penetrating the ground, a body 14, and a footplate 16 for engaging the ground (see FIG. 2) and for assisting to stabilize post assembly 10 therein. A pin 18 is removably insertable into two opposed openings 20 formed in body 14. Openings 20 are located in the center of walls forming body 14, and thus are fully bounded circumferentially by body 14. Fully bounded signifies that the walls border on openings 20 about the full circumference or perimeter of openings 20.

Rod 12 has at its proximal end an enlarged head 22 including a transverse passage 24 extending entirely through enlarged head 22. Rod 12 terminates at its distal end at a point 26. Enlarged head 22 projects radially from rod 12 in two orthogonal axes, thereby being larger in cross sectional areas than head 22 when viewed in plan.

Body 14 has a lateral wall 28 bearing openings 20 and enclosing a longitudinal cavity 30. Cavity 30 is open at the bottom of body 14, and is optionally sealed at the top of body 14 by a cap 32. Cap 32, where optionally provided, may be either integral with body 14 or removably attached thereto. Longitudinal cavity 30 cooperates in close fit with enlarged head 22 such that when enlarged head 22 is placed into cavity 30, rod 12 is constrained in its movements only to slide in a longitudinal direction relative to body 12.

Openings 20 have a diameter just greater than that of pin 18, and slightly less than that of passage 24. This arrangement enables pin 18 to be secured within body 14 by frictional fit at openings 20. Optionally, capped sleeves 34 are provided for sealing pin 18, should pin 18 be hollow, or provided with threads at its ends. This feature both protects the interior of post assembly 10 from contaminants such as dirt, water, ice, and the like, and improves the appearance in those cases wherein pin 18 is long enough to extend beyond lateral wall 28 of body 14.

When passage 24 is axially aligned with openings 20, pin 18 passes with little frictional resistance through passage 24 of enlarged head 22, with the result that rod 12 is secured to body 14 by entrapment when lowered thereonto.

Footplate 16 has an upper step 36 and a lower step 38. Upper step 36 cooperates in close fit with cavity 30 of body 14, so that the bottom edge 40 of lateral wall 28 abuts lower step 38. This is possible since lower step 38 has greater length and width dimensions than those of upper step 36. Step 38 is outwardly coextensive with body 14. This relationship is clearly shown in FIG. 6.

Footplate 16 also has a vertical bore 42 passing entirely through footplate 16. Vertical bore 42 is of diameter just greater than that of rod 12, so that rod 12 can pass through footplate 16 and is maintained in a vertical orientation by contact with footplate 16 after assembly.

Footplate 16 also has prongs 44 depending downwardly therefrom, for engaging the ground and stabilizing footplate 16, and hence post assembly 10, with respect to the ground. Prongs 44 each have a pointed end, and contact footplate 16 only at lower step 38.

Cavity 30 of body 14 and cooperating enlarged head 22 of rod 12 may be of any configuration. It is preferred that they be of configuration other than round, so that they may be mutually keyed. This configuration assures that body 14 be constrained against rotation relative to footplate 16 when lowered over upper step 36 of footplate 16.

Figure 2:
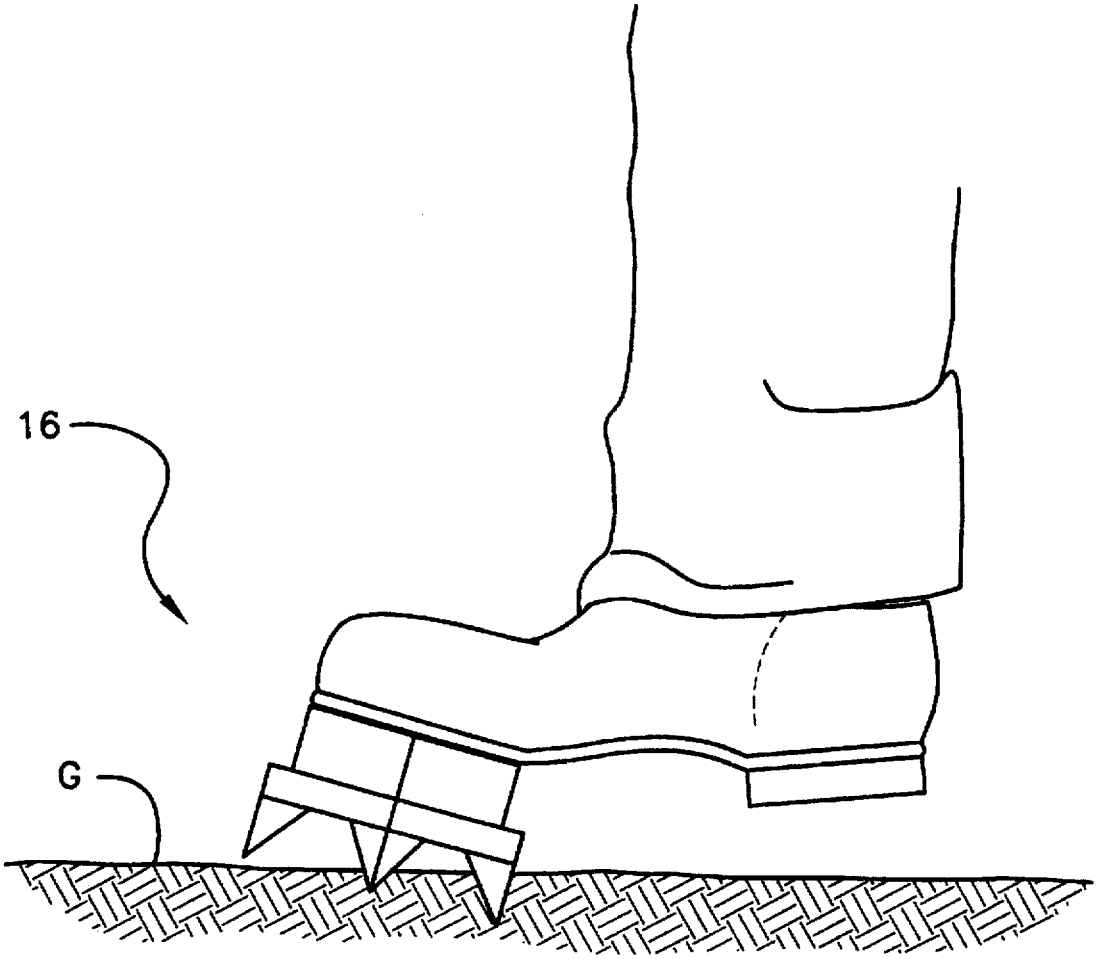
FIG. 2 is an environmental, side elevational view of a footplate component of the invention.

Referring now to FIG. 2, post assembly 10 is erected as follows. First, footplate 16 is placed at a desired location on ground G, and is forced into the ground in any suitable way. The installer may step on footplate 16, as shown, or may employ body 14 (see FIG. 1) as a driver.

Figure 3:
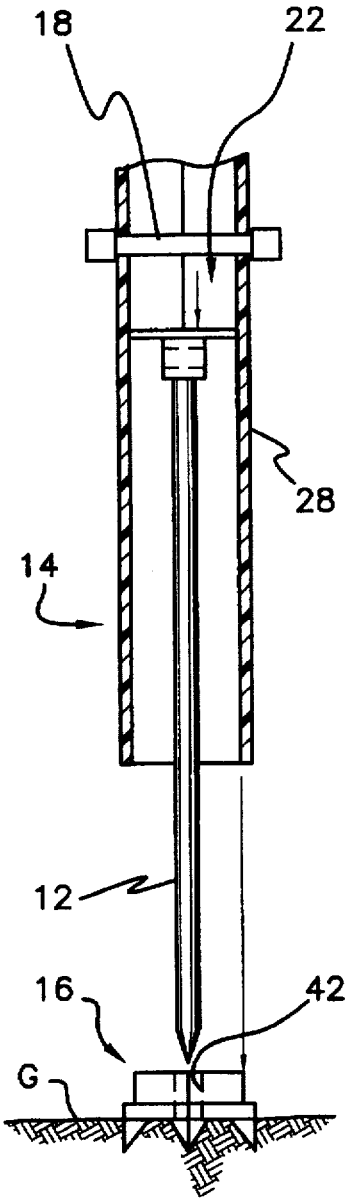
FIG. 3 is an exploded, side elevational, detail view of the invention, shown partially in cross section and broken away to reveal internal detail, showing an initial step of assembly.

Turning now to FIG. 3, rod 12 is passed through vertical bore 42 of footplate 16, and driven into ground G. With pin 18 installed in body 14, body 14 is placed over enlarged head 22 of rod 12. There is sufficient clearance between enlarged head 22 and wall 28 to allow body 14 to slide easily over rod 12.

Figure 4:
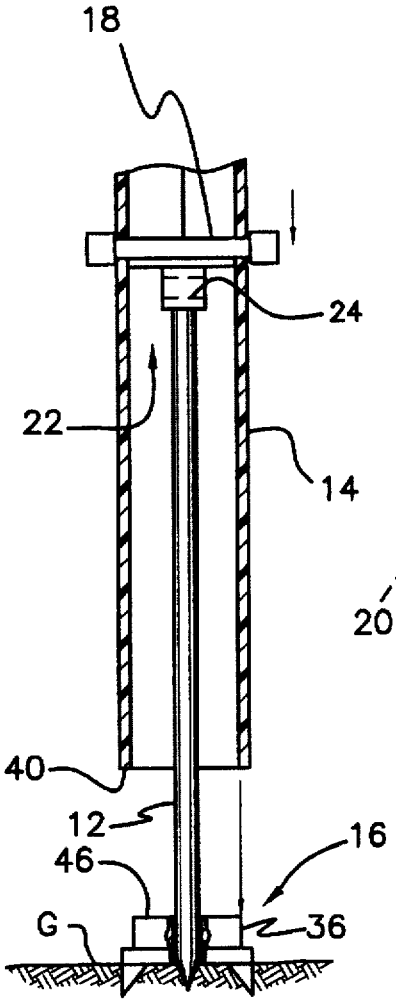
FIG. 4 is a side elevational, detail view of the invention similar to that of FIG. 3, illustrating a subsequent step of assembly.

As shown in FIG. 4, with pin 18 installed, body 14 is employed as a driver or slide hammer to deliver impacts to rod 12, forcing rod 12 into the ground G.

When bottom edge 40 of body 14 contacts or is even with the top surface 46 of upper step 36 of footplate 16, driving of rod 12 into ground G is completed. Pin 18 is removed from body 14.

Figure 5:
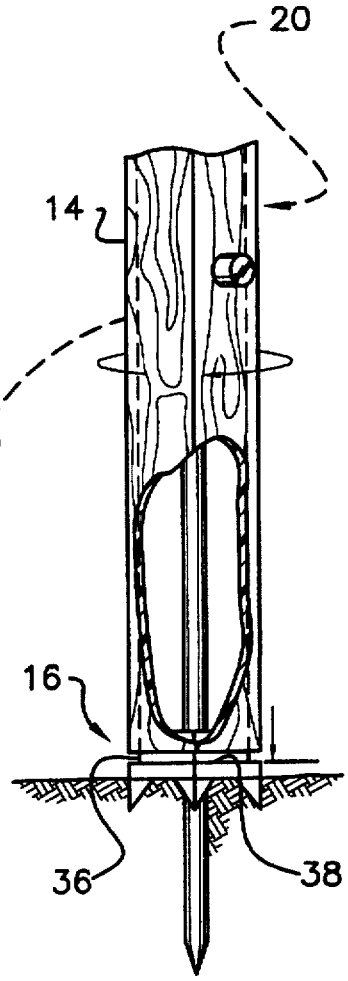
FIG. 5 is an environmental detail view of the invention, partially broken away to reveal internal detail, and showing a further step of assembly.

As shown in FIG. 5, body 14 is rotated relative to footplate 16, so that body 14 does not interfere with upper step 36 of footplate 16. Body 14 now lowers over upper step 36 until body 14 abuts lower step 38. At this point, openings 20 of body 14 are in axial alignment with passage 24 (see FIG. 4) of enlarged head 22 of rod 12.

Figure 6:
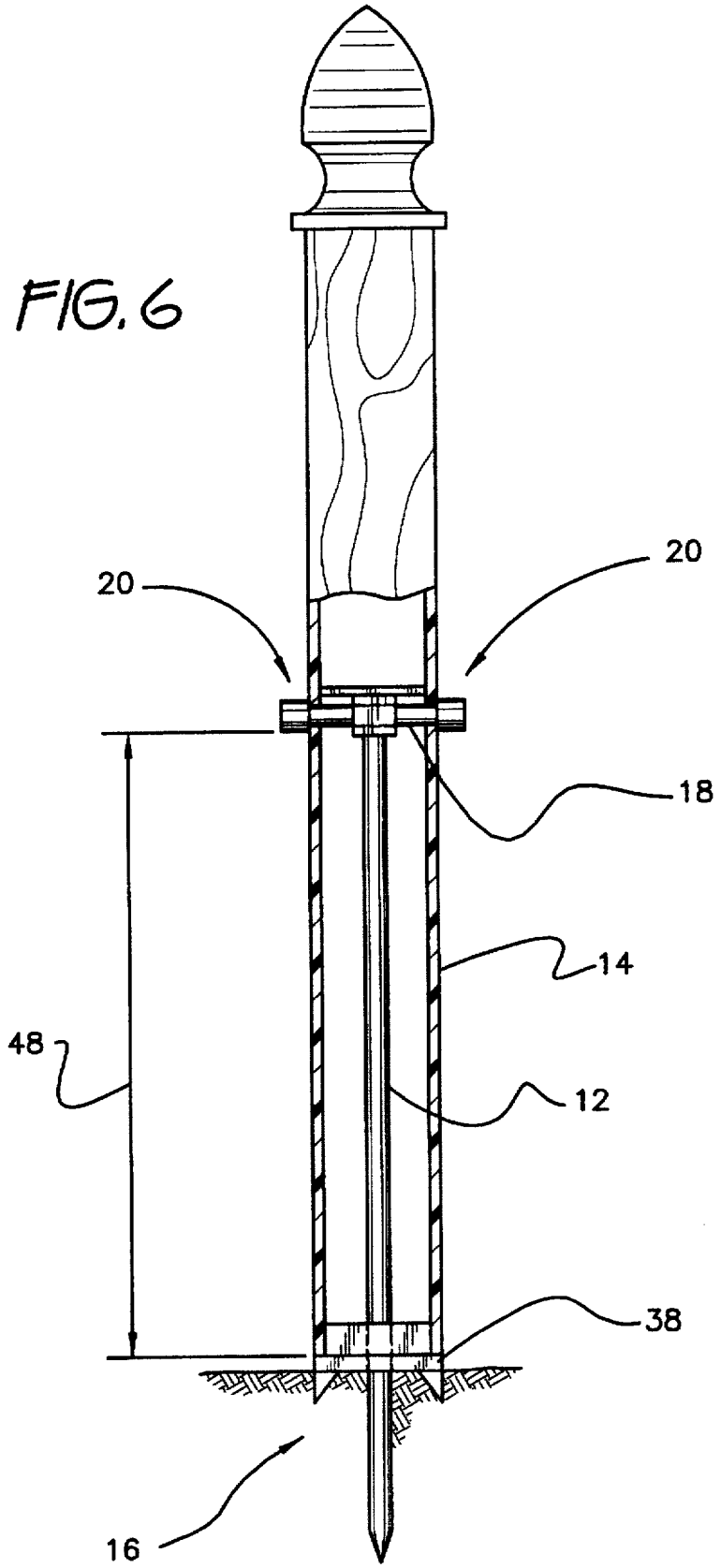
FIG. 6 is an environmental, side elevational view of the invention, partially broken away to reveal internal detail, and showing the final assembled condition.

Turning now to FIG. 6, it is seen that this relationship occurs because opposed openings 20 of body 14 are located at a predetermined distance 48 from bottom edge 40 (see FIG. 4) of body 14. This predetermined distance 48 is selected such that when pin 18 is inserted into openings 20 of body 14 and body 14 is lowered over rod 12 to the point of contact between pin 18 and rod 12, removal of pin 18 from openings 20 enables body 14 to lower into abutment with lower step 38 of footplate 16. At this point, opposed openings 20 of body 14 are then axially aligned with passage 24 (see FIG. 4) of enlarged head 22 of rod 12. Reinsertion of pin 18 through openings 20 and aligned passage 24 thus interlocks rod 12 to body 14.

Figure 7:
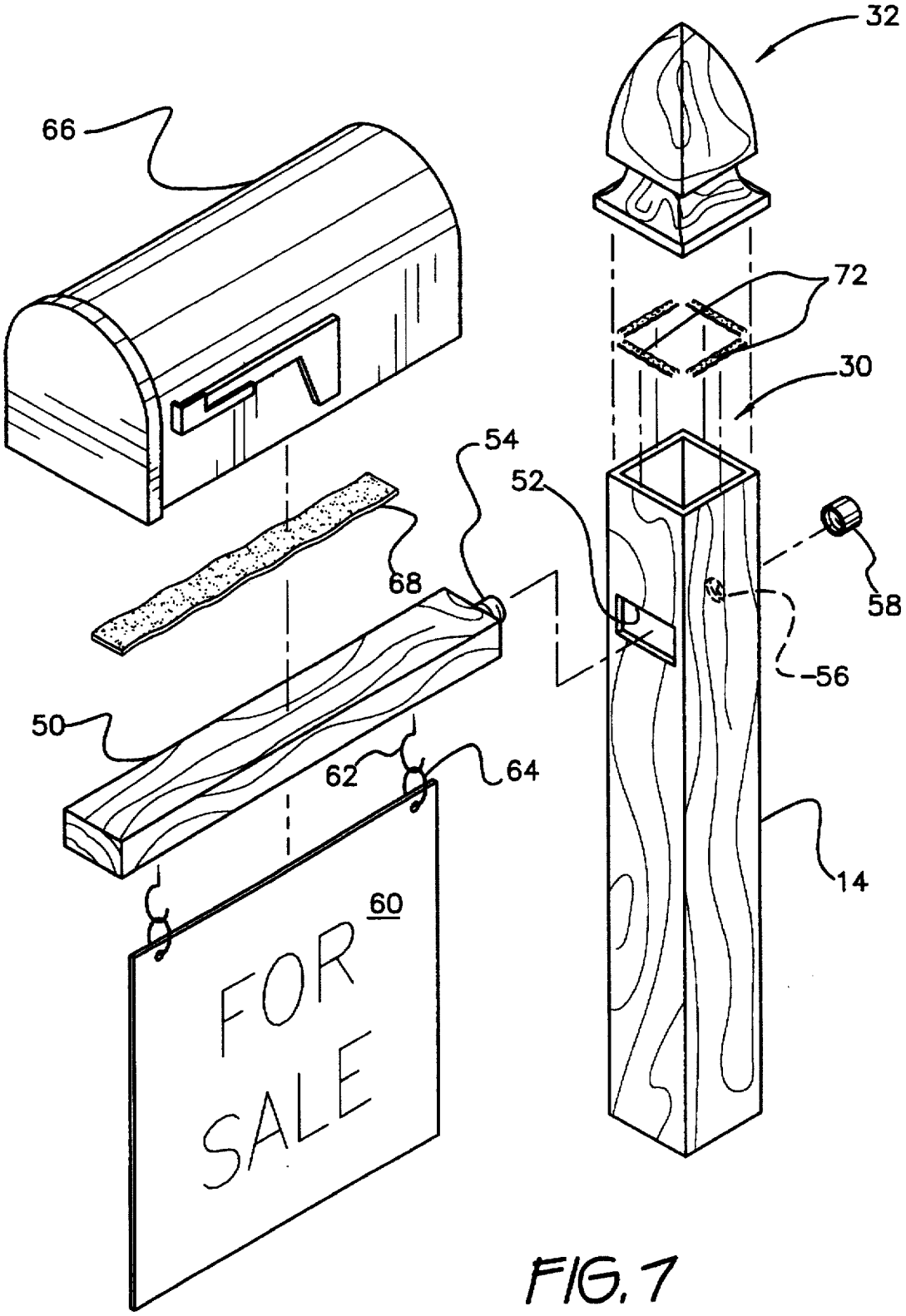
FIG. 7 is an exploded, isometric view of the invention, showing components attachable to the novel post assembly.

As shown in FIG. 7, post assembly 10 (see FIG. 1) can be employed to support a variety of objects. A laterally projecting arm 50 can be inserted into an opening 52 configured to provide a close cooperating fit with the external dimensions of arm 50. A threaded stud 54 formed in arm 50 passes through a cooperating hole 56, and is capped by a protective cap 58. Arm 50 is thus securely supported by post assembly 10.

Arm 50 can support a sign 60 which depends from arm 50 by hooks 62 and rings 64. Additionally, or alternatively, a receptacle 66 can be fastened to arm 50 from above by tape 68 having adhesive located on both sides. Receptacle 66 is illustrated as having a closure 70, as is typical of a mail box. However, a receptacle (not shown) may alternatively omit closure 70, as is traditionally practiced in receptacles for storing newspapers and like articles. The precise nature of receptacle 66 may thus vary.

Cap 32 can be attached to body 14 by strips of tape 72 having adhesive located on both sides. Alternatively, cap 32 can be fabricated to include a projection (not shown) which penetrates cavity 30, frictionally engaging the inner surfaces of body 14.

Figure 8:
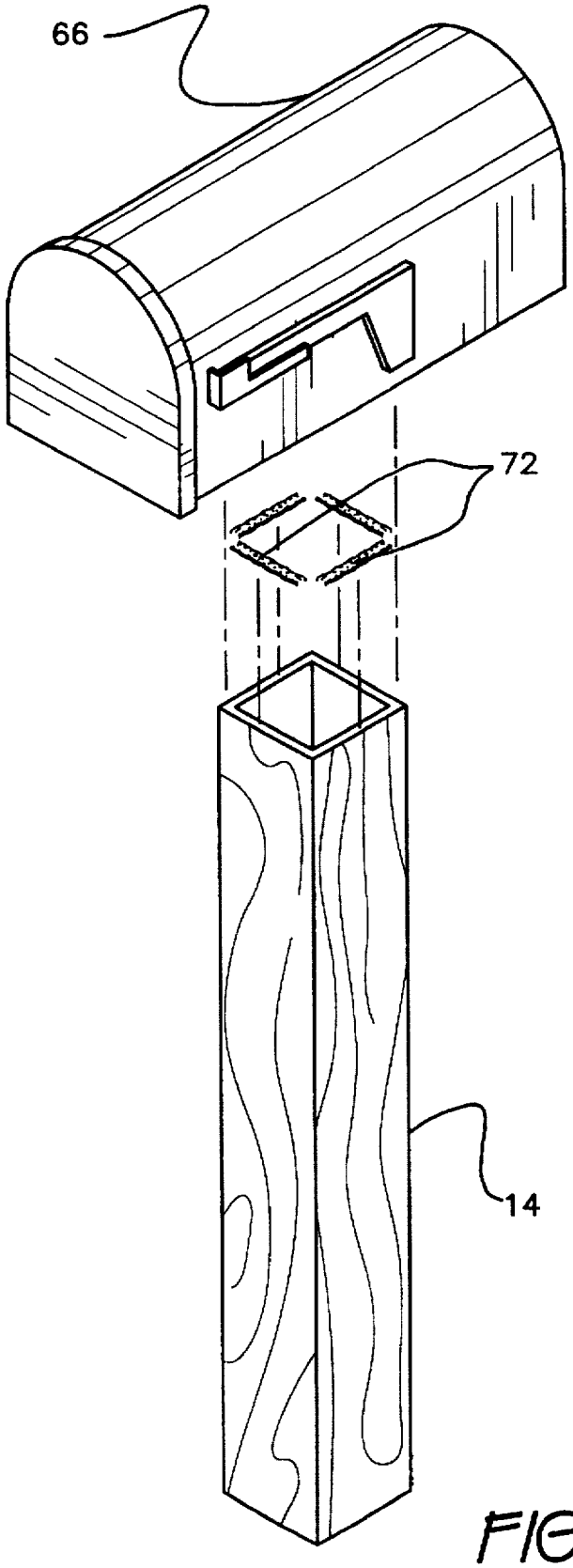
FIG. 8 is an exploded, isometric view of the invention, showing alternative attachment of a mailbox to the novel post assembly.

In another embodiment, illustrated in FIG. 8, receptacle 66 is mounted atop body 14 by strips of tape 72 having adhesive located on both sides, thereby enabling articles to be deposited and stored within receptacle 66 atop body 14.

It will be apparent to those of skill in the art that variations and modifications may be made to the invention. The precise arrangement of decorative cap 32, receptacle 66, and arm 50 may be reconfigured as desired. Attachment may be by any suitable fasteners, brackets, arrangements of peg and socket, and like fasteners which may be desired.

It is to be understood that the present invention is not limited to the embodiments described above, but encompasses any and all embodiments within the scope of the following claims.

I claim:

1. A post assembly comprising:

a rod for penetrating the ground, said rod having a proximal end, a pointed distal end, a diameter, and an enlarged head comprising a flat upper stricking surface, a member projecting radially from said rod in two orthogonal axes both perpendicular to the longitudinal dimension of the rod, said enlarged head including a transverse passage, below said flat upper striking surface, having a first diameter dimension formed in said enlarged head, said enlarged head located at said proximal end of said rod; and a body having a lateral wall including a longitudinal cavity cooperating in close fit with said enlarged head and configured to constrain said rod to move only in a longitudinal direction relative to said body, two opposed openings formed in said lateral wall of said body, said opposed openings each being fully bounded circumferentially by said body, said two opposed openings each having a second diameter dimension of magnitude slightly less than that of said first diameter dimension of said transverse passage of said enlarged head of said rod, and a pin having a third diameter dimension of magnitude just less than that of said second diameter, whereby said pin is removably insertable into said two opposed openings formed in said body of said post assembly, and through said transverse passage of said enlarged head of said rod, said body thus being securable to said rod by said pin, wherein said pin is used to contact said striking surface to drive said rod into the ground.

2. The post assembly according to claim 1, further comprising a footplate having a step outwardly coextensive with said body, said footplate having means defining a vertical bore passing through said footplate, said vertical bore having a diameter dimension just greater than said diameter of said rod, whereby said rod passes through and is maintained in a vertical orientation by said footplate.

3. The post assembly according to claim 2, said footplate further comprising a plurality of prongs depending downwardly therefrom, each prong having a pointed end, said prongs spaced apart from one another and contacting said footplate only at said lower step, for engaging the ground and stabilizing said post assembly with respect to the ground.

4. The post assembly according to claim 1, said body having a bottom edge, wherein said opposed openings of said body are located at a predetermined distance from said bottom edge of said body such that when said pin is inserted into said opposed openings of said body and said body is lowered over said rod to the point of contact between said pin and said rod, removal of said pin from said opposed openings of said body enables said body to lower into abutment with said footplate, said opposed openings of said body then being axially aligned with said passage of said enlarged head of said rod, whereby said pin interlocks said rod to said body when said pin is reinserted into said opposed openings of said body.

5. The post assembly according to claim 1, further comprising means for attaching a laterally projecting arm to said body, and an arm for lateral projection from said body, whereby a sign can be suspended from said post assembly.

6. The post assembly according to claim 1, further comprising means for attaching a receptacle atop said body, and a receptacle for attachment atop said body, whereby articles may be deposited and stored within said receptacle atop said body of said post assembly.

7. The post assembly according to claim 1, further including two capped sleeves for sealing said pin and for excluding contaminants from said body.

8. A post assembly comprising:

a rod for penetrating the ground, said rod having a proximal end, a pointed distal end, a diameter, and an enlarged head comprising a flat upper striking surface, a member projecting radially from said rod in two orthogonal axes both perpendicular to the longitudinal dimension of the rod, said enlarged head including a transverse passage, below said flat upper striking surface, having a first diameter dimension formed in said enlarged head, said enlarged head located at said proximal end;

a body having a lateral wall including a longitudinal cavity cooperating in close fit with said enlarged head and configured to constrain said rod to move only in a longitudinal direction relative to said body, two opposed openings formed in said lateral wall of said body, said opposed openings each being fully bounded circumferentially by said body, said two opposed openings each having a second diameter dimension of magnitude slightly less than that of said first diameter dimension of said transverse passage of said enlarged head of said rod, and a pin having a third diameter dimension of magnitude just less than that of said second diameter, whereby said pin is removably insertable into said two opposed openings formed in said body of said post assembly, and through said transverse passage of said enlarged head of said rod, said body thus being securable to said rod by said pin, wherein said pin is used to contact said striking surface to drive said rod into the ground; and a footplate having a plurality of prongs depending downwardly therefrom, for engaging the ground and stabilizing said post assembly with respect to the ground, an upper step having a first length dimension and a first width dimension, said upper step cooperating in close fit with said longitudinal cavity of said body, a lower step having a second length dimension of greater magnitude than that of said first length dimension of said upper step, and a second width dimension of greater magnitude than that of said second length dimension of said upper step, and means defining a vertical bore passing through said first step and said second step, said vertical bore having a diameter dimension just greater than said diameter of said rod, whereby said rod passes through and is maintained in a vertical orientation by said footplate, and said body cooperates in close fit with said footplate when lowered thereonto, said transverse passage of said enlarged head of said rod being axially aligned with said two opposed openings formed in said body when said body abuts said lower step of said footplate, said opposed openings of said body being located at a predetermined distance from said bottom edge of said body such that when said pin is inserted into said opposed openings of said body and said body is lowered over said rod to the point of contact between said pin and said rod, removal of said pin from said opposed openings of said body enables said body to lower into abutment with said lower step of said footplate, said opposed openings of said body then being axially aligned with said passage of said enlarged head of said rod, whereby said pin interlocks said rod to said body when said pin is reinserted into said opposed openings of said body.

9. The post assembly according to claim 8, further comprising means for attaching a laterally projecting arm to said body, and an arm for lateral projection from said body, whereby a sign can be suspended from said post assembly.

10. The post assembly according to claim 8, further comprising means for attaching a receptacle atop said body, and a receptacle for attachment atop said body, whereby articles may be deposited and stored within said receptacle atop said body of said post assembly.

11. The post assembly according to claim 8, further including two capped sleeves for sealing said pin and for excluding contaminants from said body.

* * * * *